US005449088A

United States Patent [19]

Howard et al.

[11] Patent Number: 5,449,088

[45] Date of Patent: Sep. 12, 1995

[54] CONTAINER FOR GASOLINE WITH EXTENDED VIEWING CAPABILITIES

[76] Inventors: Marion Howard; Carolyn M. Howard, both of P.O. Box 335, Selma, Oreg. 97538

[21] Appl. No.: 285,214

[22] Filed: Aug. 3, 1994

[51] Int. Cl.[6] ..... B65D 1/24

[52] U.S. Cl. ..... 220/662; 220/663

[58] Field of Search ..... 220/662, 663

[56] References Cited

U.S. PATENT DOCUMENTS

| | | | |
|---|---|---|---|
| 4,463,851 | 8/1984 | Cecil | 220/662 |
| 4,819,833 | 4/1989 | Huddleston et al. | 220/663 |
| 4,928,877 | 5/1990 | LaJovic | 220/663 |

*Primary Examiner*—Joseph Man-Fu Moy

[57] ABSTRACT

A container for gasoline with extended viewing capabilities comprising: a container having an essentially flat base, large generally rectangular side walls, and short parallel front and rear walls, the lower edges of the walls being in a rectangular configuration and coupled to the periphery of the base, the container also having an upper surface having a generally rectangular periphery coupled to the upper edges of the walls, one wall having a rectangular aperture therein extending vertically for the majority of the height of one wall, the upper surface having a circular aperture with an upstanding threaded flange adjacent to one wall and an upstanding handle adjacent to the rear wall; and a hollow nozzle having an upper free end and a lower end formed with the coupling components having internal threads adapted to be removably coupled to the threads of the container; and an imperforate cap having internal threads adapted to fit over the threads of the container for sealing purposes.

1 Claim, 3 Drawing Sheets

PRIOR ART

CONTAINER FOR GASOLINE WITH EXTENDED VIEWING CAPABILITIES

BACKGROUND OF THE INVENTION

1. Field of the Invention

The present invention relates to a container for gasoline with extended viewing capabilities and more particularly pertains to viewing the contents of a container of gasoline and readily determining its extent of fullness.

2. Description of the Prior Art

The use of containers for liquids of various designs and configurations is known in the prior art. More specifically, containers for liquids of various designs and configurations heretofore devised and utilized for the purpose of allowing the storage, transportation and use of a wide variety of liquids through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,416,396 a portable fuel and oil dispensing container.

U.S. Pat. No. 4,856,664 discloses a thermoplastic container having an integral nozzle, for a flammable liquid.

U.S. Pat. No. 4,901,878 discloses a rigid fluid container.

U.S. Pat. No. 4,923,098 discloses a fluid container.

U.S. Pat. No. 4,969,571 discloses a container for fluids.

U.S. Pat. No. 5,226,574 discloses a portable dispensing container for liquid fuel.

In this respect, the container for gasoline with extended viewing capabilities according to the present invention substantially departs from the conventional concepts and designs of the prior art, and in doing so provides an apparatus primarily developed for the purpose of viewing the contents of a container of gasoline and readily determining its extent of fullness.

Therefore, it can be appreciated that there exists a continuing need for a new and improved container for gasoline with extended viewing capabilities which can be used for viewing the contents of a container of gasoline and readily determining its extent of fullness. In this regard, the present invention substantially fulfills this need.

SUMMARY OF THE INVENTION

In view of the foregoing disadvantages inherent in the known types of containers for liquids of various designs and configurations now present in the prior art, the present invention provides an improved container for gasoline with extended viewing capabilities. As such, the general purpose of the present invention, which will be described subsequently in greater detail, is to provide a new and improved container for gasoline with extended viewing capabilities and method which has all the advantages of the prior art and none of the disadvantages.

To attain this, the present invention essentially comprises a new and improved container for gasoline with extended viewing capabilities comprising, in combination: a container having an essentially flat base, large generally rectangular side walls, and short parallel front and rear walls, the lower edges of the walls being in a rectangular configuration and coupled to the periphery of the base, the container also having an upper surface having a generally rectangular periphery coupled to the upper edges of the walls, the front wall having a rectangular aperture therein extending vertically for the majority of the height of the front wall, the upper surface having a circular aperture with an upstanding threaded flange adjacent to the front wall and an upstanding handle adjacent to the rear wall; a hollow nozzle having an upper free end and a lower end formed with coupling components having internal threads adapted to be removably coupled to the threaded flange of the container for pouring purposes; an imperforate cap having internal threads adapted to fit over the threaded flange of the container for sealing purposes; a transparent insert having a peripheral recess positionable in the rectangular aperture of the front wall with projections in the rectangular aperture received within the recess of the transparent insert, the transparent insert having a semi-circular cross-section with the center of curvature essentially coextensive with the vertical center line of the side wall above and below the aperture for increasing the area of contact between the fluid within the container and the transparent insert to improve the viewing capabilities thereof; and indicia formed on the side wall of the container adjacent to the transparent member to indicate the extent of fullness of the container.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container for gasoline with extended viewing capabilities which has all the advantages of the prior art containers for liquids of various designs and configurations and none of the disadvantages.

It is another object of the present invention to provide a new and improved container for gasoline with extended viewing capabilities which may be easily and efficiently manufactured and marketed.

It is further object of the present invention to provide a new and improved container for gasoline with extended viewing capabilities which is of durable and reliable constructions.

An even further object of the present invention is to provide a new and improved container for gasoline with extended viewing capabilities which is susceptible of a low cost of manufacture with regard to both materials and labor, and which accordingly is then susceptible of low prices of sale to the consuming public, thereby making such container for gasoline with extended viewing capabilities economically available to the buying public.

Still yet another object of the present invention is to provide a new and improved container for gasoline with extended viewing capabilities which provides in the apparatuses and methods of the prior art some of the advantages thereof, while simultaneously overcoming some of the disadvantages normally associated therewith.

Still another object of the present invention is to view the contents of a container of gasoline and readily determine its extent of fullness.

Lastly, it is an object of the present invention to provide a new and improved container for gasoline with extended viewing capabilities comprising: a container having an essentially flat base, large generally rectangular side walls, and short parallel front and rear walls, the lower edges of the walls being in a rectangular configuration and coupled to the periphery of the base, the container also having an upper surface having a generally rectangular periphery coupled to the upper edges of the walls, one wall having a rectangular aperture therein extending vertically for the majority of the height of one wall, the upper surface having a circular aperture with an upstanding threaded flange adjacent to one wall and an upstanding handle adjacent to the rear wall; and a hollow nozzle having an upper free end and a lower end formed with the coupling components having internal threads adapted to be removably coupled to the threads of the container; and an imperforate cap having internal threads adapted to fit over the threads of the container for sealing purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
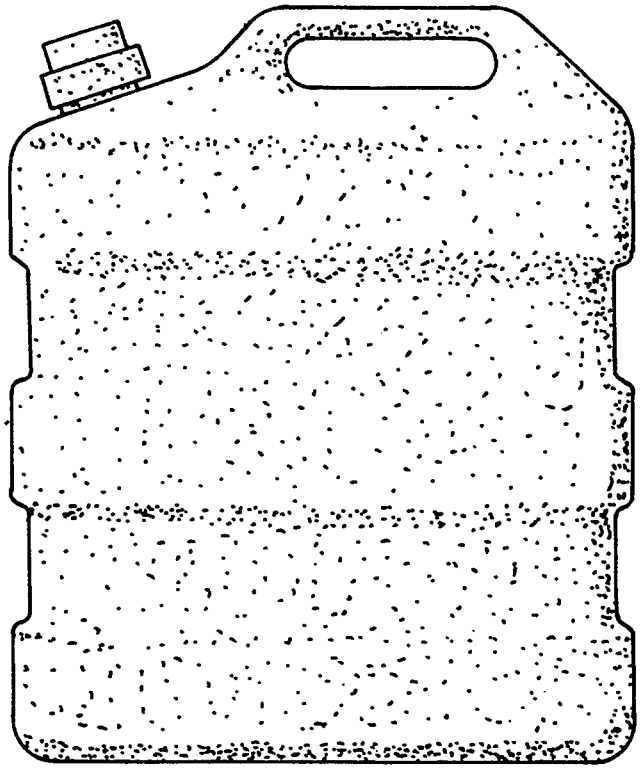
FIG. 1 is a front elevational view of a prior art container for liquids such as gasoline.
Figure 2:
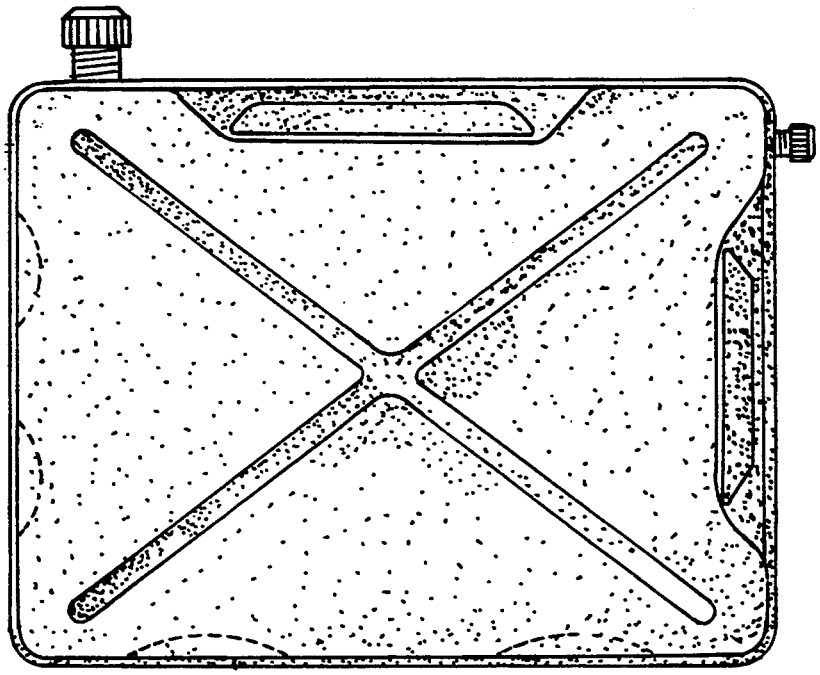
PRIOR ART Fig. 2
FIG. 2 is a side elevational view of another container from the prior art adapted to support, transport and retain liquids such as gasoline.
Figure 3:
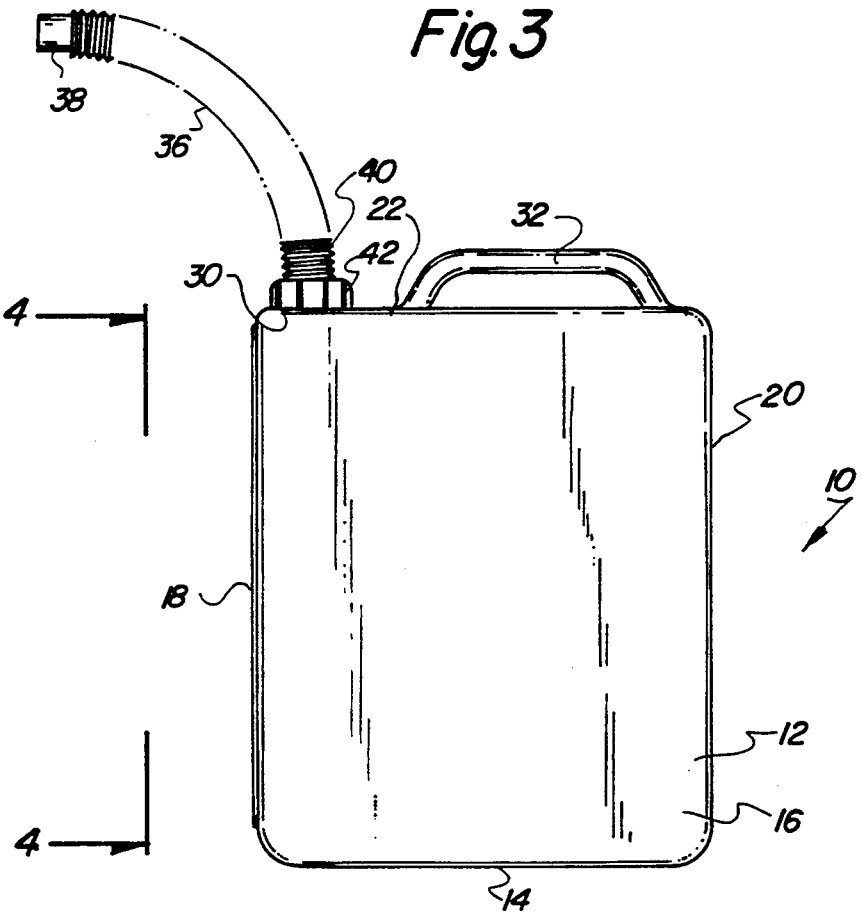
FIG. 3 is a side elevational view of the preferred embodiment of the new and improved container for gasoline with extended viewing capabilities constructed in accordance with the principles of the present invention.
Figure 4:
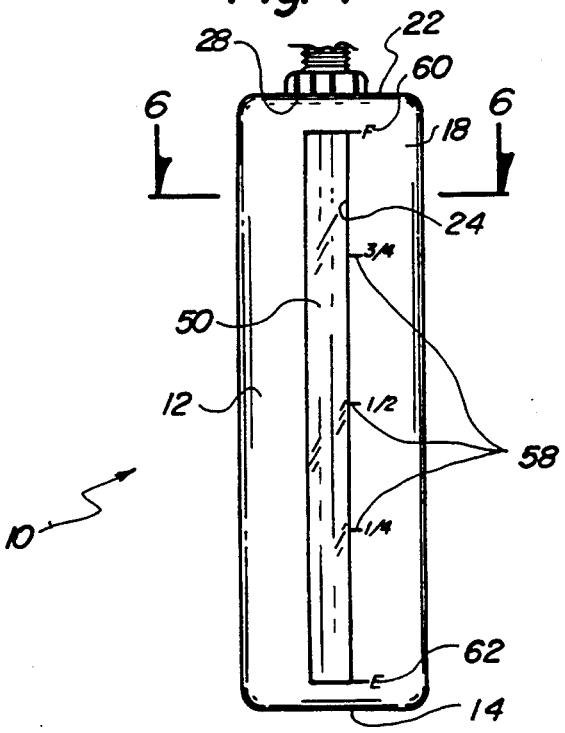
FIG. 4 is a side elevational view of the device shown in FIG. 3 taken along line 4—4 of FIG. 3.
Figure 5:
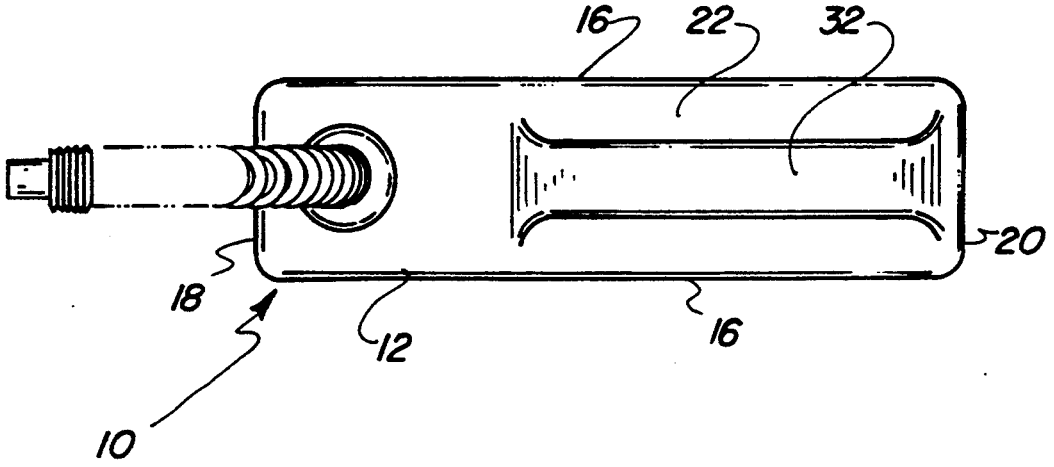
FIG. 5 is a top elevational view of the container shown in FIGS. 3 and 4.
Figure 6:
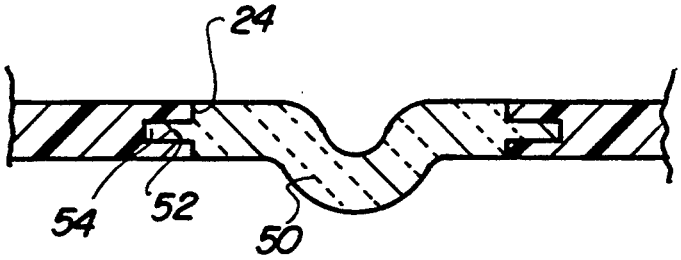
FIG. 6 is a cross-sectional view taken along line 6—6 of FIG. 4.

With reference now to the drawings, and in particular to FIG. 1 thereof, the preferred embodiment of the new and improved container for gasoline with extended viewing capabilities embodying the principles and concepts of the present invention and generally designated by the reference numeral 10 will be described.

The present invention, the new and improved container for gasoline with extended viewing capabilities, is a system comprised of a plurality of components. Such components, in their broadest context, include a container, a hollow nozzle, an imperforate cap, a transparent insert and indicia. Such components are individually configured and correlated with respect to each other so as to attain the desired objective.

The central component of the system 10 is a container 12. The container has an essentially flat face 14. It also has large generally rectangular side walls 16. It also has short parallel front and rear walls 18 and 20. The lower edges of the walls are in a rectangular configuration and coupled to the periphery of the base. The container also has an upper surface 22 having a generally rectangular periphery coupled to the upper edges of the wall. The front wall has a rectangular aperture 24 therein. Such aperture extends vertically for the majority of the height of the front wall.

The upper surface has a circular aperture 28. From adjacent such aperture is an upstanding flange 30 with threads formed in the exterior surface thereof. The aperture and flange are adjacent to the front wall. The upper surface also is formed with an upstanding handle 32 adjacent to the rear wall.

Next provided is a hollow nozzle 36. The nozzle has an upper free end 38 and a lower end 40 formed with coupling components having internal threads 42. Such threads are adapted to be reciprocally coupled to the threads of the flange of the container for pouring out the contents of the container.

Also provided in association with the flange of the container is an imperforate cap 46. The cap has a cylindrical wall with internal threads. Such threads are adapted to fit over the threaded flange of the container. This arrangement is for sealing purposes.

The next component of the system 10 of the present invention is a transparent insert 50. The insert is preferably formed of a rigid plastic material. It has a peripheral recess 52. Such recess is adapted to be located to be received in the rectangular aperture of the front wall. Inwardly directed projections 54 of a rigid construction but with thin walls project inwardly into the rectangular aperture. Such projections are received in the recess at the periphery of the transparent insert.

The transparent insert has a semi-circular cross-section from top to bottom. The center of curvature is essentially coextensive with the vertical center line of the side wall above and below the aperture. The curvature of the insert is for increasing the area of contact between the fluid within the container and the transparent insert. This allows for improving the viewing capability of the liquid to more readily determine the surface level of the fluid within the container.

In order to assist a user to determine the extent of fullness of the container, indicia 58 is formed on the side wall adjacent to the insert. The indicia is in the form of markings to indicate full 60 and empty 62 and any number of a plurality of markings therebetween so that the percent of fullness of the container may be readily determined.

The present invention is a container and dispenser for gasoline which provides one with the ability to actually see the level of the fluid contained therein.

It is constructed much like any conventional gas container and includes a flexible dispensing spout and threaded cap; however, a clear transparent strip is incorporated at one end of the container. This strip is narrow and extends over the entire height of the vessel, and it is blended continuously with the adjoining plastic wall to form a seal at the interface of the transparent strip and the wall.

From the foregoing description, it can be seen that one can see the exact location of the top surface of the fluid within the container at a glance simply by rotating the container and viewing it from the end with the transparent strip.

The idea is simple but very effective and it will be of value in two distinct ways. First, one can actually monitor the level of gas as the container is filled, and spillage and overflow will be completely eliminated. Secondly, the level of fluid can be ascertained before starting a job, such as mowing the lawn, and one will never have the problem of running out of fuel before the job has been completed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved container for gasoline with extended viewing capabilities comprising, in combination:

a container having an essentially flat base, large generally rectangular side walls, and short parallel front and rear walls, the lower edges of the walls being in a rectangular configuration and coupled to the periphery of the base, the container also having an upper generally horizontal surface having a generally rectangular periphery coupled to the upper edges of the walls, the front wall having a rectangular aperture therein extending vertically for the majority of the height of the front wall, the upper surface having a circular aperture with an upstanding threaded flange adjacent to the front wall and an upstanding handle adjacent to the rear wall;

a hollow nozzle having an upper free end and a lower end formed with coupling components having internal threads adapted to be removably coupled to the threaded flange of the container for pouring purposes;

an imperforate cap having internal threads adapted to fit over the threaded flange of the container for sealing purposes;

a transparent insert having a peripheral recess positionable in the rectangular aperture of the front wall with projections in the rectangular aperture received within the recess of the transparent insert, the transparent insert having a convex semi-circular cross-section extending outwardly from the container with the center of curvature essentially coextensive with the vertical center line of the side wall above and below the aperture for increasing the area of contact between the fluid within the container and the transparent insert to improve the viewing capabilities thereof; and indicia formed on the side wall of the container adjacent to the transparent member to indicate the extent of fullness of the container.

* * * * *